US006783332B2

(12) United States Patent
Umemura et al.

(10) Patent No.: US 6,783,332 B2
(45) Date of Patent: Aug. 31, 2004

(54) CONTROL VALVE OF VARIABLE DISPLACEMENT COMPRESSOR WITH PRESSURE SENSING MEMBER

(75) Inventors: Satoshi Umemura, Kariya (JP); Kazuya Kimura, Kariya (JP); Ryo Matsubara, Kariya (JP); Masaki Ota, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 41 days.

(21) Appl. No.: 10/205,324

(22) Filed: Jul. 25, 2002

(65) Prior Publication Data

US 2003/0021698 A1 Jan. 30, 2003

(30) Foreign Application Priority Data

Jul. 25, 2001 (JP) ..... 2001-225115

(51) Int. Cl.[7] ..... F04B 1/26

(52) U.S. Cl. ..... 417/222.2; 137/340

(58) Field of Search ..... 417/212, 222.2; 137/340, 565.16; 251/129.15; 62/132, 226, 228.1, 228.5

(56) References Cited

U.S. PATENT DOCUMENTS

| | | | | |
|---|---|---|---|---|
| 6,354,811 | B1 * | 3/2002 | Ota et al. | 417/222.2 |
| 6,361,283 | B1 * | 3/2002 | Ota et al. | 417/222.2 |
| 6,449,971 | B1 * | 9/2002 | Kimura et al. | 62/228.3 |
| 2002/0037223 | A1 | 3/2002 | Suitou et al. | 417/222.2 |

* cited by examiner

*Primary Examiner*—Justine R. Yu
*Assistant Examiner*—John F. Belena
(74) *Attorney, Agent, or Firm*—Morgan & Finnegan, LLP

(57) ABSTRACT

A control valve controls the displacement of a variable displacement compressor. The control valve includes a first valve body for adjusting the pressure in a crank chamber, a pressure sensing member, which is displaced in accordance with the pressure difference between two pressure points located in a refrigerant circuit to move the first valve body, an electromagnetic actuator for urging the pressure sensing member, and a second valve body, which is operably coupled to the pressure sensing member. The second valve body adjusts the opening degree of a discharge passage of the refrigerant circuit in accordance with the displacement of the pressure sensing member. Therefore, compared to a case where the first and second valve bodies are independently arranged in the compressor, the number of parts are reduced, which reduces the manufacturing cost.

20 Claims, 4 Drawing Sheets

CONTROL VALVE OF VARIABLE DISPLACEMENT COMPRESSOR WITH PRESSURE SENSING MEMBER

BACKGROUND OF THE INVENTION

The present invention relates to a control valve for controlling the displacement of a variable displacement compressor that is used in a vehicular air-conditioner.

A typical variable displacement compressor (hereinafter, referred to as a compressor) used in a vehicular air-conditioner includes a clutch mechanism, such as an electromagnetic clutch, on a power transmission path between an external drive source of the air-conditioner, which is the engine of the vehicle, and the compressor. When refrigeration is not needed, the electromagnetic clutch is turned off to discontinue power transmission from the engine to the compressor, thereby deactivating the compressor.

Turning on and off the electromagnetic clutch generates a shock, which lowers the engine performance of the vehicle. Therefore, clutchless type compressors are now widely being used. In a clutchless type compressor, the clutch mechanism, such as an electromagnetic clutch, is not arranged on the power transmission path between the engine and the compressor.

The clutchless type compressors use swash plate type variable displacement compressors. A swash plate type variable displacement compressor varies displacement in accordance with changes in the pressure in a crank chamber, which accommodates a swash plate. The pressure in the crank chamber of such compressor is controlled by adjusting the opening degree of a control valve, which is located in the compressor. The compressor includes a shutter, which is arranged in a discharge passage. The discharge passage connects a discharge chamber to an external refrigerant circuit. When the displacement of the compressor is minimized and the pressure acting on the discharge chamber side of the shutter decreases, the shutter mechanically detects the decrease and closes the discharge passage.

When refrigeration is not needed, the control valve minimizes the displacement of the compressor, thereby minimizing the power loss of the engine. In addition, the shutter prevents the refrigerant gas from being discharged to the external refrigerant circuit. This substantially stops the function of the compressor.

However, the control valve for controlling the displacement and the shutter for selectively opening the discharge passage are independently arranged in the compressor. This increases the number of parts forming the compressor, which increases the manufacturing cost of the compressor.

SUMMARY OF THE INVENTION

Accordingly, it is an objective of the present invention to provide a control valve that has some functions in addition to controlling the displacement of a variable displacement compressor to reduce the manufacturing cost of the compressor.

To achieve the above objective, the present invention provides a control valve for controlling the displacement of a variable displacement compressor that is incorporated in a refrigerant circuit. The compressor includes a control pressure chamber. The displacement of the compressor varies in accordance with the pressure in the control pressure chamber. The control valve includes a first valve body, a pressure sensing member, an actuator, and a second valve body. The first valve body varies the valve opening to adjust the pressure in the control pressure chamber. The pressure sensing member is displaced in accordance with the pressure in the refrigerant circuit to move the first valve body such that the displacement of the compressor is controlled to cancel the fluctuation of the pressure in the refrigerant circuit. The actuator urges the pressure sensing member by a force that corresponds to an external command to determine a target value of the pressure in the refrigerant circuit. The second valve body is operably coupled to the pressure sensing member. The second valve body adjusts the opening degree of a refrigerant passage, which forms a part of the refrigerant circuit, in accordance with the displacement of the pressure sensing member.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 5.

Figure 1:
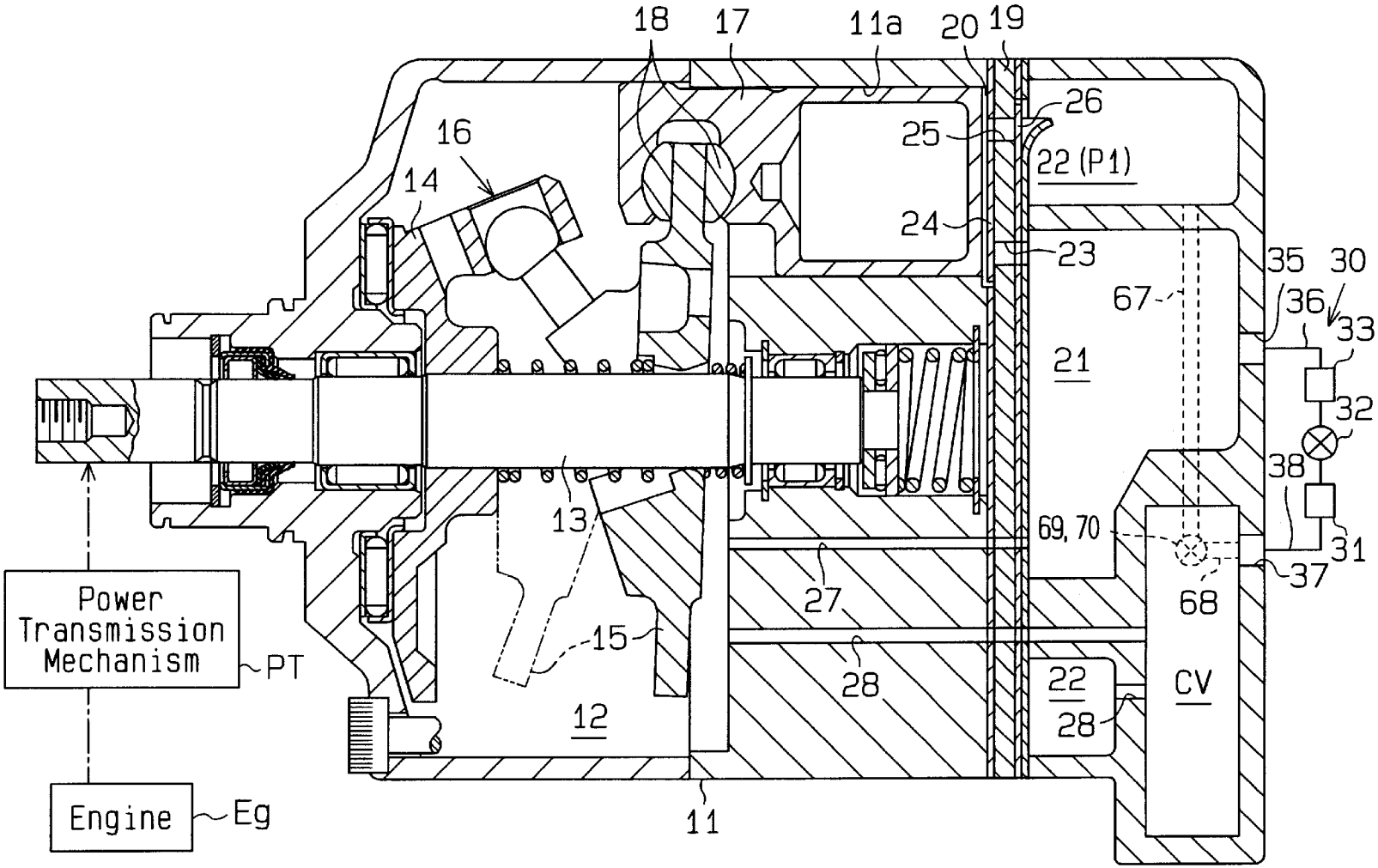
FIG. 1 is a cross-sectional view illustrating a swash plate type variable displacement compressor according to a first embodiment of the present invention.

FIG. 1 shows a swash plate type variable displacement compressor (hereinafter, simply referred to as a compressor), which includes a housing assembly 11. A control pressure chamber, which is a crank chamber 12 in the first embodiment, is defined in the housing assembly 11. A drive shaft 13 extends through the crank chamber 12 and is rotatably supported by the housing assembly 11. The drive shaft 13 is connected to and driven by a vehicular drive source, which is an engine Eg in the first embodiment, through a power transmission mechanism PT. That is, the engine Eg serves as an external drive source of the compressor. In FIG. 1, the left end of the compressor is defined as the front end, and the right end of the compressor is defined as the rear end.

In this embodiment, the power transmission mechanism PT is a clutchless mechanism that includes, for example, a belt and a pulley. The power transmission mechanism PT therefore constantly transmits power from the engine Eg to the compressor when the engine Eg is running. Alternatively, the mechanism PT may be a clutch mechanism (for example, an electromagnetic clutch) that selectively transmits power when supplied with a current. Unlike a clutch type power transmission mechanism, which generates shock when turned on and off, the clutchless type power transmission mechanism PT does not generate a shock and is also advantageous for reducing weight.

A lug plate 14 is coupled to the drive shaft 13 and is located in the crank chamber 12. The lug plate 14 rotates integrally with the drive shaft 13. A swash plate 15 is accommodated in the crank chamber 12. The swash plate 15 slides along and inclines with respect to the drive shaft 13.

A hinge mechanism 16 is arranged between the lug plate 14 and the swash plate 15. Therefore, the swash plate 15 rotates integrally with the lug plate 14 and the drive shaft 13. The hinge mechanism 16 also permits the swash plate 15 to slide along and incline with respect to the drive shaft 13.

The housing assembly 11 has cylinder bores 11*a* (only one is shown). Each cylinder bore 11*a* accommodates a single-headed piston 17. Each piston 17 reciprocates inside the corresponding cylinder bore 11*a*. Each piston 17 is coupled to the peripheral portion of the swash plate 15 by a pair of shoes 18. The shoes 18 convert the rotation of the swash plate 15, which rotates with the drive shaft 13, to reciprocation of the pistons 17.

The housing assembly 11 includes a valve plate assembly 19, which closes the opening of each cylinder bore 11*a*. A compression chamber 20 is defined in each cylinder bore 11*a* by the corresponding piston 17 and the valve plate assembly 19. The housing assembly 11 defines a suction chamber 21, which is a suction pressure zone, and a discharge chamber 22, which is a discharge pressure zone, at the rear portion.

As each piston 17 moves from the top dead center to the bottom dead center, refrigerant gas in the suction chamber 21 is drawn into the corresponding compression chamber 20 through the corresponding suction port 23 while flexing the suction valve flap 24 to an open position. Refrigerant gas that is drawn into the compression chamber 20 is compressed to a predetermined pressure as the piston 17 is moved from the bottom dead center to the top dead center. Then, the gas is discharged to the discharge chamber 22 through the corresponding discharge port 25 while flexing the discharge valve flap 26 to an open position.

As shown in FIG. 1, a bleed passage 27 and a supply passage 28 are formed in the housing assembly 11. The bleed passage 27 connects the crank chamber 12 to the suction chamber 21.

The supply passage 28 connects the crank chamber 12 to the discharge chamber 22. The supply passage 28 is regulated by a control valve CV.

The opening degree of the control valve CV is adjusted to control the balance of the flow rate of highly pressurized gas supplied to the crank chamber 12 through the supply passage 28 and the flow rate of gas conducted out from the crank chamber 12 through the bleed passage 27. The pressure in the crank chamber 12 is thus adjusted. The inclination angle of the swash plate 15 is changed in accordance with the pressure in the crank chamber 12. The stroke of the pistons 17, or the displacement of the compressor, is controlled, accordingly.

For example, a decrease in the pressure in the crank chamber 12 increases the inclination angle of the swash plate 15, which increases the displacement of the compressor. On the contrary, an increase in the pressure in the crank chamber 12 decreases the inclination angle of the swash plate 15, which decreases the displacement of the compressor.

As shown in FIG. 1, a refrigerant circuit of the vehicular air-conditioner includes the compressor and an external refrigerant circuit 30, which is connected to the compressor. The external refrigerant circuit 30 includes a condenser 31, an expansion valve 32, and an evaporator 33.

A downstream pipe 36 is located downstream of the external refrigerant circuit 30. The downstream pipe 36 connects the outlet of the evaporator 33 to an inlet 35, which is formed in the housing assembly 11 of the compressor. An upstream pipe 38 is located upstream of the external refrigerant circuit 30. The upstream pipe 38 connects an outlet 37, which is formed in the housing assembly 11, to the inlet of the condenser 31. The compressor draws refrigerant gas from downstream of the external refrigerant circuit 30 to the suction chamber 21 through the inlet 35. The refrigerant gas is then compressed and discharged to the discharge chamber 22, which is connected to upstream of the external refrigerant circuit 30, via the outlet 37.

Figure 2:
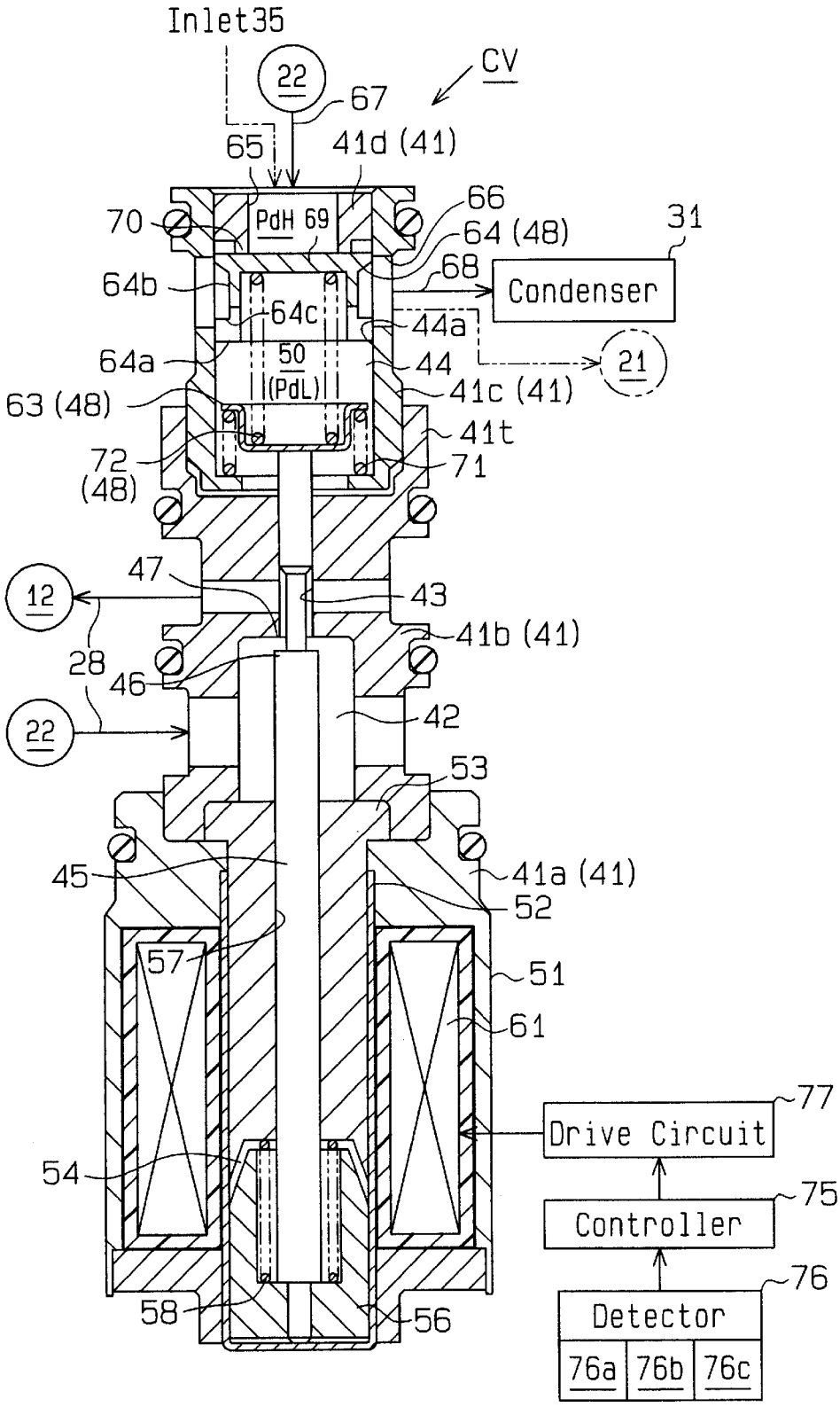
FIG. 2 is a cross-sectional view illustrating the control valve located in the compressor shown in FIG. 1.
Figure 4:
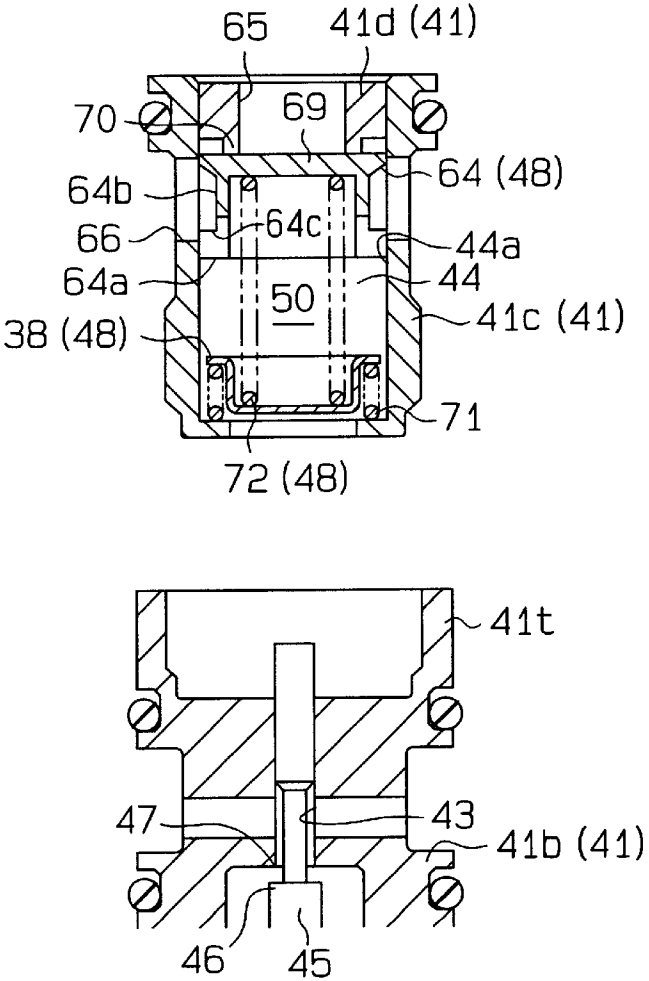
FIG. 4 is an enlarged partial cross-sectional view illustrating the assembling procedure of the control valve shown in FIG. 2.
Figure 3:
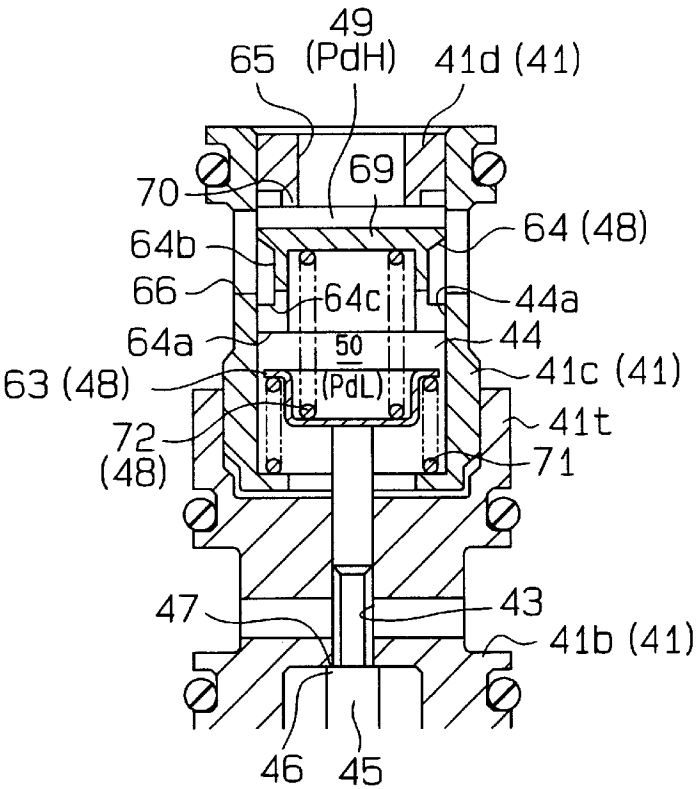
FIG. 3 is an enlarged partial cross-sectional view explaining the operation of the control valve shown in FIG. 2.

As shown in FIGS. 2 to 4, a valve housing 41, which constitutes a housing of the control valve CV, includes a lower portion 41*a*, a middle portion 41*b*, an upper portion 41*c*, and a plug 41*d*. The lower portion 41*a* and the middle portion 41*b*, which is fitted to the upper part of the lower portion 41*a*, constitute a first housing assembly. The upper portion 41*c* and the plug 41*d*, which is press fitted in the upper opening of the upper portion 41*c*, constitute a second housing assembly. The middle portion 41*b* includes a cylindrical portion 41*t*, to which the lower part of the upper portion 41*c* is press fitted.

The middle portion 41*b* defines a communication passage 43. The middle portion 41*b* and the lower portion 41*a* with 53 define a valve chamber 42, which is arranged below the communication passage 43. A pressure sensing chamber 44 is defined by the upper portion 41*c* and the plug 41*d*. A transmission rod 45 is arranged in the valve chamber 42 and the communication passage 43 and moves in the axial direction (vertical direction as viewed in FIG. 2). The communication passage 43 is disconnected from the pressure sensing chamber 44 by the upper end of the transmission rod 45, which extends through and slides with respect to the communication passage 43. The valve chamber 42 is communicated with the discharge chamber 22 by the upstream section of the supply passage 28. The communication passage 43 is communicated with the crank chamber 12 by the downstream section of the supply passage 28. The valve chamber 42 and the communication passage 43 constitute a part of the supply passage 28.

A first valve body 46, which is formed at the middle of the transmission rod 45, is arranged in the valve chamber 42. A step located at the boundary of the valve chamber 42 and the communication passage 43 serves as a valve seat 47 and the communication passage 43 serves as a valve hole. When the transmission rod 45 is located at the lowermost position as shown in FIG. 2, the opening degree of the communication passage 43, or the valve hole 43, is maximized. When the transmission rod 45 moves to the uppermost position where the first valve body 46 contacts the valve seat 47, the valve hole 43 is disconnected from the valve chamber 42. The opening degree of the valve hole 43, or the opening degree of the supply passage 28, is adjusted in accordance with the axial position of the transmission rod 45. The first valve body 46 functions to adjust the opening degree of the supply passage 28 to vary the displacement of the compressor.

A pressure sensing member 48 is accommodated in the pressure sensing chamber 44. The pressure sensing member 48 includes a cup-shaped first member 63 and an inverted cup-shaped second member 64. The first member 63 moves downward and the second member 64 moves upward in the pressure sensing chamber 44. A flange-like guide portion 64*a* is formed at the lower portion of the second member 64. A guide portion 64*a* of the second member 64 slides along the inner circumferential surface 44*a* of the pressure sensing chamber 44. The second member 64 define a first pressure chamber 49, which is the upper space, and a second pressure chamber 50, which is the lower space, in the pressure sensing chamber 44.

The plug 41*d* of the valve housing 41 includes an introduction port 65, which is connected to the first pressure chamber 49. An outlet port 66 is formed on the side of the upper portion 41*c*. When the second member 64 moves downward from the position shown in FIG. 2 (uppermost position), the side of the first pressure chamber 49, or the outlet port 66 opens. A first passage 67 connects the discharge chamber 22 in the housing assembly 11 to the introduction port 65. A second passage 68 connects the outlet 37 to the outlet port 66. The first passage 67, the introduction port 65, the first pressure chamber 49, the outlet port 66, and the second passage 68 form a discharge passage, which connects the discharge chamber 22 to the outlet 37.

That is, the control valve CV is located on the refrigerant circuit and the first pressure chamber 49 constitutes a part of the refrigerant circuit.

A second valve body 69 is integrally formed with the upper portion of the second member 64 and located inside the first pressure chamber 49. A step located at the boundary of the first pressure chamber 49 and the introduction port 65 serves as a valve seat 70 and the introduction port 65 serves as a valve hole. When the second member 64 is arranged at the uppermost position, the second valve body 69 contacts the valve seat 70 and closes the introduction port 65. When the second member 64 moves downward from the uppermost position, the second valve body 69 opens the introduction port 65. That is, the second valve body 69 of the second member 64 controls the opening degree of the discharge passage 67, 65, 49, 66, and 68.

A recess 64*b* is formed on the outer circumferential surface of the second member 64 corresponding to the outlet port 66. A communication groove 64*c* is formed in a part of the guide portion 64*a*. The communication groove 64*c* communicates the recess 64*b* with the second pressure chamber 50. Therefore, the second pressure chamber 50 is always communicated with the outlet port 66 by the communication groove 64*c* and the recess 64*b*.

That is, the first pressure chamber 49 is exposed to the pressure PdH before passing through a restrictor, which is the space between the second valve body 69 and the valve seat 70. The second pressure chamber 50 is exposed to the pressure PdL after passing through the restrictor. Therefore, the second pressure chamber 50 is exposed to the pressure at the downstream of the first pressure chamber 49, or the low pressure section. The difference ΔPd (ΔPd=PdH−PdL) between pressures acting on two points (two pressure points) at the front and rear of the second valve body 69 and the valve seat 70 correlates with the flow rate of refrigerant gas in the refrigerant circuit. Therefore, detecting the pressure difference ΔPd permits the displacement of the compressor to be indirectly detected.

A first spring 71, which forces the first member 63 toward the second member 64, is accommodated in the pressure sensing chamber 44. A second spring 72, which serves as urging means constituting the pressure sensing member 48, is arranged between the first member 63 and the second member 64 in the pressure sensing chamber 44. Therefore, the first member 63 is pressed against the upper end of the transmission rod 45 by the force of the second spring 72 and vertically moves integrally with the transmission rod 45. The second member 64 is urged by the force of the second spring 72 such that the second valve body 69 contacts the valve seat 70. The pressure sensing chamber 44 (the first pressure chamber 49 and the second pressure chamber 50), the pressure sensing member 48 (the first member 63, the second member 64, and the second spring 72), and the first spring 71 constitute a pressure sensing mechanism.

The lower portion 41*a* of the valve housing 41 has a target pressure changing means, which is an electromagnetic actuator 51 in this embodiment. The electromagnetic actuator 51 includes an accommodating cylinder 52 at the center of the lower portion 41*a*. A stationary iron core 53 is fitted in the upper opening of the accommodating cylinder 52. The stationary iron core 53 defines a plunger chamber 54 at the lowermost portion in the accommodating cylinder 52.

A movable iron core 56 is housed in the plunger chamber 54 to move in the axial direction of the control valve CV. A guide hole 57 axially extends through the center of the stationary iron core 53. The lower end of the transmission rod 45 is arranged in the guide hole 57 and axially moves along the guide hole 57. The lower end of the transmission rod 45 is fitted to the movable iron core 56 in the plunger chamber 54. Therefore, the transmission rod 45 always moves integrally with the movable iron core 56. A core urging spring 58 is arranged between the stationary iron core 53 and the movable iron core 56. The core urging spring 58 urges the movable iron core 56 away from the stationary iron core 53.

A coil 61 is wound about the stationary iron core 53 and the movable iron core 56. The coil 61 is connected to a drive circuit 77, and the drive circuit 77 is connected to a controller 75. The controller 75 is connected to an external information detector 76. The controller 75 receives external information (on-off state of an air-conditioner switch 76*a*, the in-car temperature detected by a temperature sensor 76*b*, and a target temperature determined by a temperature adjuster 76*c*) from the detector 76. Based on the received information, the controller 75 commands the drive circuit 77 to supply a drive signal to the coil 61.

When the drive circuit 77 supplies a current to the coil 61, the coil 61 generates an electromagnetic force (electromagnetic attraction force), the magnitude of which depends on the value of the supplied current, between the movable iron core 56 and the stationary iron core 53. The electromagnetic force is then transmitted to the transmission rod 45 by the movable iron core 56.

The value of the current supplied to the coil 61 is controlled by controlling the voltage applied to the coil 61. The applied voltage is controlled by pulse-width modulation (PWM).

The position of the transmission rod 45, or the opening degree of the first valve body 46, and the position of the second member 64 of the pressure sensing member 48, or the opening degree of the second valve body 69, are controlled in the following manner. For purpose of facilitating explanation, the effect of the pressure in the valve chamber 42, the communication passage 43, and the plunger chamber 54 on positioning of the transmission rod 45 and the second member 64 is ignored.

Figure 5:
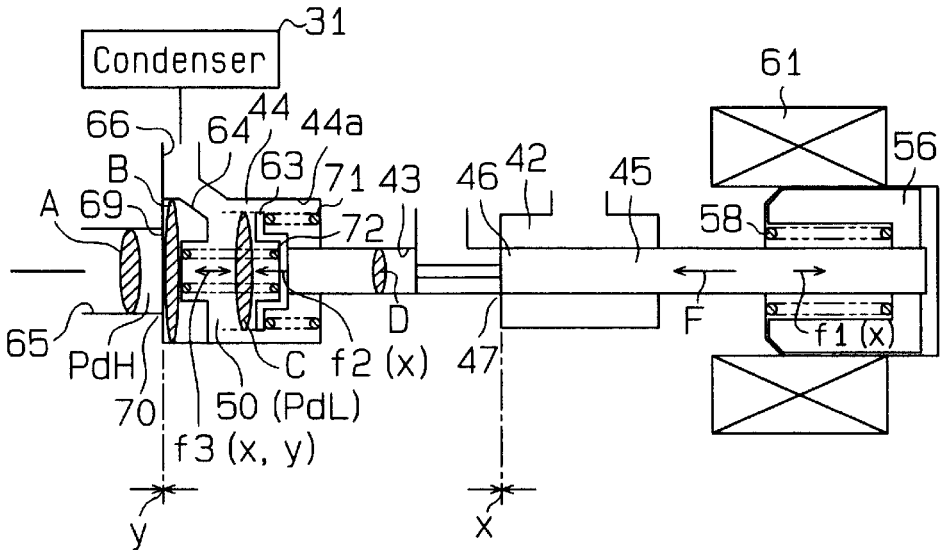
FIG. 5 is a diagrammatic view explaining the operation of the control valve shown in FIG. 2.

As shown in FIG. 2, when the coil 61 is supplied with no electric current (duty ratio=0%), or when the air-conditioner switch 76*a* is turned off, the position of the transmission rod 45 is dominantly determined by the downward force of the core urging spring 58 and the downward force of the second spring 72 (f1 (x)+f3 (x, y)), as shown in FIG. 5. Thus, the transmission rod 45 is placed at its lowermost position, and the communication passage 43 is fully opened. This maximizes the pressure in the crank chamber 12. The difference between the pressure in the crank chamber 12 and the pressure in the compression chamber 20 thus becomes great. As a result, the inclination angle of the swash plate 15 is minimized, and the discharge displacement of the compressor is also minimized. Therefore, the load torque of the compressor, or the torque required to drive the compressor, is minimized. This reduces the power loss of the engine Eg while the refrigeration is not needed.

When the displacement of the compressor is minimized, the pressure PdH in the discharge chamber 22, or the first pressure chamber 49, decreases. In this state, the pressure PdL in the second pressure chamber 50 is close to the pressure PdH in the first pressure chamber 49. Therefore, the downward force applied to the second member 64 based on the pressure difference ΔPd between the pressure in the first pressure chamber 49 and the pressure in the second pressure chamber 50 is also reduced. Therefore, the second member 64 is arranged at the uppermost position by the force f3 (x, y) of the second spring 72. Accordingly, the second valve body 69 fully closes the introduction port 65 and closes the discharge passage 67, 65, 49, 66, and 68. That is, a clutchless type power transmission mechanism PT does not perform refrigeration unnecessarily because the flow of refrigerant through the external refrigerant circuit 30 is stopped and the compressor is substantially stopped.

As shown in FIG. 3, when a current of a minimum duty ratio, which is greater than 0%, is supplied to the coil 61 of the control valve CV, the upward electromagnetic force F surpasses the resultant of the downward forces of the core urging spring 58 and the second spring 72 (f1(x)+f3 (x, y)), which moves the transmission rod 45 upward. When the transmission rod 45 moves upward and the opening degree of the first valve body 46 decreases from the fully opened state, the pressure in the crank chamber 12 decreases and the compressor increases displacement from the minimum displacement.

When the compressor displacement increases from the minimum displacement, the pressure PdH in the discharge chamber 22, or the pressure PdH in the first pressure chamber 49, increases. Therefore, the pressure difference ΔPd between the first pressure chamber 49 and the second pressure chamber 50 increases. Therefore, the downward force that acts on the second member 64 based on the pressure difference ΔPd increases, and the electromagnetic force cannot balance the forces acting on the transmission rod 45. Therefore, the second member 64 moves downward against the force f3 (x, y) of the second spring 72, and the second valve body 69 opens the introduction port 65. Thus, the discharge passage 67, 65, 49, 66, and 68 is opened and refrigerant starts to flow through the external refrigerant circuit 30.

As shown in FIG. 5, the resultant of the downward force f1 (x) of the core urging spring 58 and the upward electromagnetic force F acts against the downward force (which will be described later) of the pressure sensing mechanism. That is, the position of the first valve body 46 of the transmission rod 45 is determined such that upward and downward forces are balanced.

The downward force of the pressure sensing mechanism that acts on the transmission rod 45 is determined by the resultant of the upward force f2 (x) of the first spring 71, the downward force f3 (x, y) of the second spring 72, the downward force that acts on the first member 63 due to the difference between the size of the pressure receiving area of the upper and lower surfaces of the first member 63 inside the second pressure chamber 50, and the downward force that acts on the second member 64 based on the pressure difference ΔPd between the first pressure chamber 49 and the second pressure chamber 50.

Therefore, the transmission rod 45 is located at the position that satisfies the following equation. In the following equation, the letter A represents the cross-sectional area of the introduction port 65, the letter B represents the cross-sectional area viewed from the top and bottom of the second member 64, the letter C represents the cross-sectional area viewed from the top and bottom of the first member 63, and the letter D represents a cross-sectional area of the upper end of the transmission rod 45.

$$\begin{aligned} F &= PdH\cdot A + PdL(B-A) - PdL\cdot B + PdL\cdot C - PdL\cdot(C-D) + \\ &\quad f1(x) - f2(x) + f3(x, y) \\ &= PdH\cdot A - PdL\cdot A + PdL\cdot D + f1(x) - f2(x) + f3(x, y) \end{aligned}$$

The cross-sectional area D of the transmission rod 45 is smaller than the cross-sectional area A of the introduction port 65. Therefore, the effect of the PdL·D on the positioning of the transmission rod 45 is small. Thus, the equation can be simplified as follows. The equation is simplified also for purpose of facilitating understanding.

$$F=(PdH-PdL)\cdot A+f1(x)-f2(x)+f3(x, y)$$

Part of the equation (PdH−PdL)·A represents that the downward force based on the pressure difference ΔPd between the first pressure chamber 49 and the second pressure chamber 50 acts on the transmission rod 45 as the total pressure exerted by the pressure sensing member 48 (first member 63 and the second member 64).

The reference force when the first valve body 46 is fully closed is represented by f1 (set). The valve opening of the first valve body 46, or the stroke distance with respect to the valve seat 47, is represented by x. The spring constant is represented by k1. In this case, the downward force f1(x) of the core urging spring 58 is represented by the following equation:

$$f1(x)=f1(\text{set})-k1\cdot x$$

The upward force f2 (x) of the first spring 71 is represented by the following equation:

$$f2(x)=f2(\text{set})+k2\cdot x$$

The force f3 (x, y) of the second spring 72 is varied in accordance with the position of the second member 64, or the stroke distance y of the second valve body 69 with respect to the valve seat 70. Therefore, when the first valve body 46 is fully closed and the second valve body 69 is fully closed (as shown in FIG. 5), the force f3 (x, y) is represented by the following equation. The reference force is represented by f3 (set) and the spring constant is represented by k3:

$$f3(x, y)=f3(\text{set})+k3(y-x)$$

Therefore, the second member 64 is located at the position that satisfies the following equation:

$$PdH\cdot A+PdL(B-A)-PdL\cdot B=f3(\text{set})+k3(y-x)$$

$$(PdH-PdL)A=f3(\text{set})+k3(y-x)$$

In the first embodiment, dimensions are determined and springs 71, 72 are selected such that the movable area of the second member 64, or the fluctuation range of the distance y, is much greater than the movable area of the transmission rod 45, or the fluctuation range of the distance x, taking into consideration of the function of the first valve body 46 and the second valve body 69. Thus, the distance x may be handled as a constant value for determining the position of the second member 64.

That is, there is no problem in considering that the opening degree (distance y) of the second valve body 69 is changed in accordance only with the fluctuation of the pressure difference ΔPd.

For example, if the flow rate of the refrigerant in the refrigerant circuit is decreased due to a decrease in the speed of the engine Eg, the downward force based on the pressure difference ΔPd acting on the pressure sensing member 48 decreases, and the electromagnetic force F cannot balance the upward and downward forces acting on the transmission rod 45. Therefore, the transmission rod 45 (the first valve body 46) moves upward to compensate for the decrease of the pressure difference ΔPd. This decreases the opening degree of the communication passage 43 and thus lowers the pressure in the crank chamber 12. Accordingly, the inclination angle of the swash plate 15 is increased, and the displacement of the compressor is increased. The increase in the displacement of the compressor increases the flow rate of the refrigerant in the refrigerant circuit, which increases the pressure difference ΔPd to a value before the speed of the engine Eg started to decrease.

In contrast, when the flow rate of the refrigerant in the refrigerant circuit is increased due to an increase in the speed of the engine Eg, the downward force based on the pressure difference ΔPd increases and the current electromagnetic force F cannot balance the forces acting on the transmission rod 45. Therefore, the first valve body 46 moves downward to compensate for the increase in the pressure difference ΔPd and increases the opening degree of the communication passage 43. This increases the pressure in the crank chamber 12. Accordingly, the inclination angle of the swash plate 15 is decreased, and the displacement of the compressor is also decreased. The decrease in the displacement of the compressor decreases the flow rate of the refrigerant in the refrigerant circuit, which decreases the pressure difference ΔPd to a value before the speed of the engine Eg started to increase.

When the duty ratio of the electric current supplied to the coil 61 is increased to increase the electromagnetic force F, the pressure difference ΔPd cannot balance the forces acting on the transmission rod 45. Therefore, the first valve body 46 moves upward to compensate for the increase of the electromagnetic force F and decreases the opening degree of the communication passage 43. As a result, the displacement of the compressor is increased. Accordingly, the flow rate of the refrigerant in the refrigerant circuit is increased and the pressure difference ΔPd is increased.

On the other hand, when the pressure difference ΔPd is increased, the second member 64 of the pressure sensing member 48 moves downward against the force f3 (x) of the second spring 72. Therefore, the opening degree of the second valve body 69, or the distance y between the second valve body 69 and the valve seat 47, increases. That is, when the flow rate of refrigerant is great and the difference between the pressures acting on the front and rear of the restrictor is excessive, the opening between the second valve body 69 and the valve seat 70 decreases. This suppresses the pressure loss caused by refrigerant gas passing between the second valve body 69 and the valve seat 70.

On the contrary, when the duty ratio of the electric current supplied to the coil 61 is decreased and the electromagnetic force F is decreased accordingly, the pressure difference ΔPd cannot balance the forces acting on the transmission rod 45. Therefore, the first valve body 46 moves downward to compensate for the decrease in the electromagnetic force F, which increases the opening degree of the communication passage 43. As a result, the compressor displacement is decreased. Accordingly, the flow rate of the refrigerant in the refrigerant circuit is decreased, and the pressure difference ΔPd is decreased.

On the other hand, the second member 64 of the pressure sensing member 48 moves upward by the force f3 (x) of the second spring 72 when the pressure difference ΔPd decreases, thereby decreasing the opening degree of the second valve body 69, or the distance y between the second valve body 69 and the valve seat 47. Accordingly, the opening for refrigerant gas between the second valve body 69 and the valve seat 70 increases. Thus, the pressure difference ΔPd is increased even when the flow rate of refrigerant is small and the difference between the pressures acting on the front and the rear sides of the restrictor is too small. As a result, the position of the transmission rod 45 is determined accurately based on the pressure difference ΔPd when the flow rate of refrigerant is small and the displacement of the compressor is reliably controlled by the control valve CV.

As described above, the target value of the pressure difference ΔPd is determined by the duty ratio of current supplied to the coil 61. The control valve CV automatically determines the position of the transmission rod 45 according to changes of the pressure difference ΔPd to maintain the target value of the pressure difference ΔPd. The target value of the pressure difference ΔPd is externally controlled by adjusting the duty ratio of current supplied to the coil 61.

The above illustrated embodiment has the following advantages.

(1) The control valve CV includes a valve structure (such as the first valve body 46) for controlling the displacement of the compressor and a valve structure (such as the second valve body 69) for selectively opening and closing the discharge passage 67, 65, 49, 66, 68 of the refrigerant circuit. Therefore, compared to a case where the valves are independently arranged in the compressor, the number of parts are reduced, which reduces the manufacturing cost.

(2) The second valve body 69 for selectively opening and closing the discharge passage 67, 65, 49, 66, 68 is coupled to and driven by the pressure sensing member 48 (the second member 64), which determines the position of the first valve body 46. Therefore, a dedicated pressure sensing mechanism for the second valve body 69 need not be arranged. Thus, the advantage described in (1) is more effectively provided.

(3) The first embodiment differs from a case where a variable target suction pressure control valve is used (this case does not depart from the concept of the present invention) in that the control valve CV does not refer to the suction pressure, which is affected by the thermal load of the evaporator 33. The displacement of the compressor is feedback controlled based on the pressure difference ΔPd between the first pressure chamber 49 and the second pressure chamber 50, which are defined in the control valve CV in the refrigerant circuit.

Thus, the compressor displacement is quickly and reliably controlled based on the fluctuation of the engine speed and by the controller 75 without being influenced by the thermal load on the evaporator 33. Particularly, when the speed of the engine Eg increases, the compressor displacement is reliably and quickly decreased, which improves the fuel economy. That is, the control valve CV according to the first embodiment is particularly suitable for vehicular air-conditioners.

(4) The space between the second valve body 69 and the valve seat 70 located between the first pressure chamber 49 and the second pressure chamber 50 serves as a restrictor for restricting the flow of refrigerant gas through the discharge passage 67, 65, 49, 66, and 68. Therefore, the control valve CV does not require a dedicated restrictor for increasing the pressure difference ΔPd that is detected by the pressure sensing member 48. This simplifies the displacement control structure of the compressor.

(5) The opening degree of the space between the second valve body 69 and the valve seat 70 is determined in accordance with the flow rate of refrigerant in the refrigerant circuit. That is, the restrictor formed between the second valve body 69 and the valve seat 70 is a variable restrictor. Therefore, the pressure loss is decreased when the flow rate of refrigerant is great and the pressure difference ΔPd is increased when the flow rate of refrigerant is small. That is, the displacement is reliably controlled.

(6) The first pressure chamber 49 of the control valve CV constitutes a part of the refrigerant circuit. Therefore, the second valve body 69 for selectively opening and closing the refrigerant circuit can be arranged in the first pressure chamber 49 and the second valve body 69 can be formed integrally with the pressure sensing member 48 (the second member 64). The second valve body 69 is accommodated in the first pressure chamber 49 and does not require its own space, thus reducing the size of the control valve CV. Also, the second valve body 69 is integrally formed with the pressure sensing member 48, which further minimizes the control valve CV.

Since the first pressure chamber 49 constitutes a part of the refrigerant circuit, the control valve CV does not require a dedicated passage for drawing the pressure PdH in the refrigerant circuit (for example, pressure in the discharge chamber 22) into the first pressure chamber 49. This simplifies the control valve structure of the compressor and reduces the manufacturing cost of the air-conditioner.

(7) The second member 64, which includes the second valve body 69, abuts against the transmission rod 45 (the first valve body 46) via the second spring 72 and the first member 63. That is, the second valve body 69 moves relatively to the first valve body 46. Therefore, the first valve body 46 and the second valve body 69 can be simultaneously displaced in conflicting directions. That is, the first valve body 46 is fully opened to minimize the compressor displacement simultaneously as the second valve body 69 is fully closed to disconnect the introduction port 65. The movable area of the first valve body 46 may be set differently from the movable area of the second valve body 69. This adds to the flexibility of the design.

(8) As shown in FIG. 4, the valve housing 41 of the control valve CV includes the first housing assembly 41*a*, 41*b*, which includes the transmission rod 45 (the first valve body 46) and the electromagnetic actuator 51, and the second housing assembly 41*c*, 41*d*, which includes the pressure sensing mechanism (such as the pressure sensing member 48) and the second valve body 69. That is, each of primary functions, such as an electromagnetic valve function, a pressure sensing function, and a refrigerant passage opening and closing function, is formed as a unit in the control valve CV. This facilitates the assembling of the control valve CV.

The transmission rod 45 in the first housing assembly 41*a*, 41*b* and the pressure sensing member 48 (the first member 63) in the second housing assembly 41*c*, 41*d* are coupled to each other only by inserting the first housing assembly 41*a*, 41*b* to the second housing assembly 41*c*, 41*d* when assembling the control valve CV. That is, members of each unit are operably connected by only inserting the units to each other. This further facilitates the assembling of the control valve CV.

Further, the engaging condition of the transmission rod 45 and the pressure sensing member 48 can be adjusted in accordance with the insertion degree of the first housing assembly 41*a*, 41*b* and the second housing assembly 41*c*, 41*d*. That is, when the first housing assembly 41*a*, 41*b* is inserted into the second housing assembly 41*c*, 41*d* deeply, the reference urging force f2 (set) of the first spring 71 is reduced and the reference urging member f3 (set) of the second spring 72 is increased. On the contrary, when the first housing assembly 41*a*, 41*b* is inserted into the second housing assembly 41*c*, 41*d* shallowly, the reference urging force f2 (set) of the first spring 71 is increased and the reference urging force f3 (set) of the second spring 72 is reduced. As a result, the spring load, or the operating characteristics of the control valve CV, is easily adjusted by changing the insertion degree of the first housing assembly 41*a*, 41*b* into the second housing assembly 41*c*, 41*d*.

Figure 6:
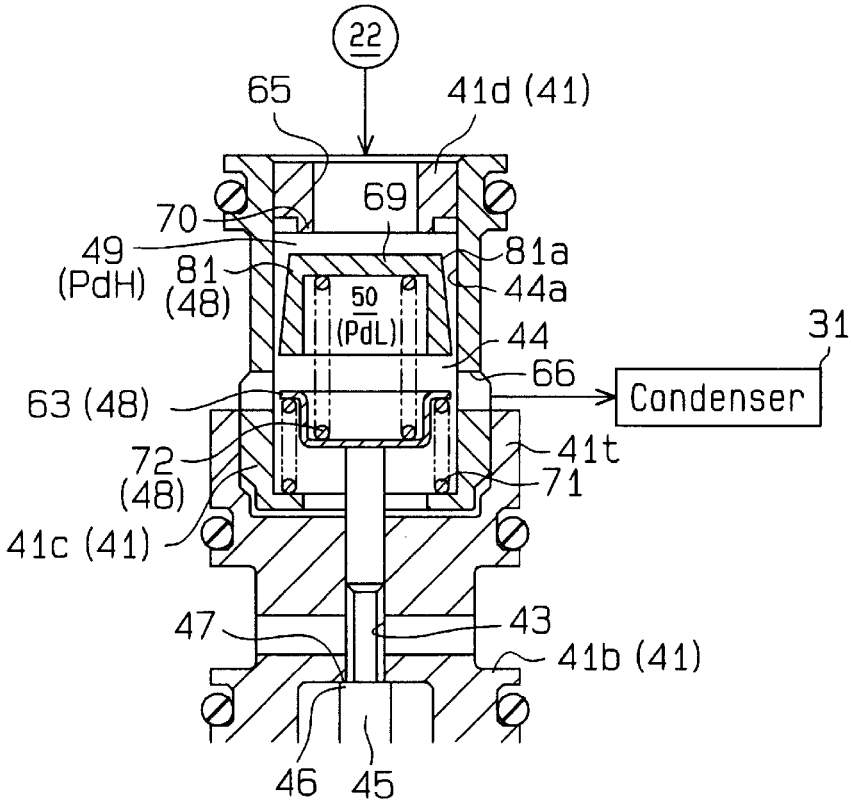
FIG. 6 is an enlarged partial cross-sectional view illustrating a control valve according to a second embodiment of the present invention.

A second embodiment of the present invention will now be described with reference to FIG. 6. The differences from the first embodiment of FIGS. 1–5 will mainly be discussed below. The outlet port 66 is formed on the side portion of the second pressure chamber 50 at the upper portion 41*c* of the valve housing 41. The second member 81 of the pressure sensing member 48 is columnar. The outer circumferential surface 81*a* of the second member 81 is tapered such that the diameter is reduced toward the first pressure chamber 49.

Refrigerant gas introduced into the first pressure chamber 49 through the introduction port 65 is drawn into the second pressure chamber 50 through the space between the outer circumferential surface 81*a* of the second member 81 and the inner circumferential surface 44*a* of the pressure sensing member 48. Refrigerant gas introduced into the second pressure chamber 50 is discharged to the second passage 68 through the outlet port 66. That is, in the second embodiment, the space between the second member 81 and the pressure sensing chamber 44 and the second pressure chamber 50 also constitute a part of the discharge passage (refrigerant circuit). Particularly, the space between the outer circumferential surface 81*a* of the second member 81 and the inner circumferential surface 44*a* of the pressure sensing chamber 44 serves as a chamber-to-chamber passage connecting the first pressure chamber 49 and the second pressure chamber 50 in the refrigerant circuit.

In the second embodiment, the space between the outer circumferential surface 81*a* of the second member 81 and the inner circumferential surface 44*a* of the pressure sensing chamber 44 serves as a restrictor instead of the space between the second valve body 69 and the valve seat 70. The restrictor increases the pressure difference ΔPd between the first pressure chamber 49 and the second pressure chamber 50.

The second embodiment provides the same advantages as (1) to (3) and (6) to (8) of the first embodiment. The second embodiment further provides the following advantages.

(1) Since the first and second pressure chambers 49, 50 constitute a part of the refrigerant circuit, dedicated passages for introducing each pressure PdH, PdL into the corresponding first or second pressure chamber 49, 50 are not required. Therefore, the control valve structure of the compressor is further simplified, thereby reducing the manufacturing cost of the air-conditioner.

(2) The space between the outer circumferential surface 81*a* of the second member 81 and the inner circumferential surface 44*a* of the pressure sensing chamber 44 is used as the chamber-to-chamber passage, which connects the first pressure chamber 49 to the second pressure chamber 50 in the refrigerant passage. Therefore, it is not required to machine a passage, which connects the first pressure chamber 49 to the second pressure chambers 50 via the outside of the control valve CV, or to arrange a passage inside the housing assembly 11.

Further, since refrigerant flows through the first pressure chamber 49 to the second pressure chamber 50, foreign objects do not easily get stuck between the outer circumferential surface 81*a* of the second member 81 and the inner circumferential surface 44*a* of the pressure sensing chamber 44. Even when foreign objects get stuck, the foreign objects are expected to be removed by the flow of refrigerant. Maintaining smooth displacement of the second member 81 for a long period improves reliability of the control valve CV.

(3) The space between the outer circumferential surface 81*a* of the second member 81 and the inner circumferential surface 44*a* of the pressure sensing chamber 44 is larger on the side close to the first pressure chamber 49 than on the side close to second pressure chamber 50. Therefore, the refrigerant flow from the first pressure chamber 49 to the second pressure chamber 50 through the space causes the second member 81 to be automatically aligned. This reduces the sliding resistance between the second member 81 and the pressure sensing chamber 44. Accordingly, the operating characteristics of the control valve CV is improved.

That is, in the case when the axis of the second member 81 is displaced with respect to the axis of the valve housing 41, force is applied to the second member 81 in a direction opposite to the decentering direction, thereby automatically modifying the alignment of the second member 81 with respect to the axis of the valve housing 41. This is caused because the pressure distribution in the axial direction differs between the narrower space and the wider space, which are located between the outer circumferential surface 81*a* of the second member 81 and the inner circumferential surface 44*a* of the pressure sensing chamber 44.

It should be apparent to those skilled in the art that the present invention may be embodied in many other specific forms without departing from the spirit or scope of the invention.

A pressure sensing mechanism of the control valve CV may be located in the suction passage, which connects the inlet 35 to the suction chamber 21. That is, for example, as shown by a line made up of one long and two short dashes in FIG. 2, the introduction port 65 of the control valve CV may be connected to the inlet 35 via the upstream section of the suction passage, and the outlet port 66 may be connected to the suction chamber 21 via the downstream section of the suction passage.

In this case, the pressure sensing member 48 of the control valve CV is displaced in accordance with the pressure difference between two points located in the suction pressure zone in the refrigerant circuit. The second valve body 69 of the second member 64, 81 closes the suction passage when the displacement of the compressor is minimized. This stops the flow of refrigerant through the external refrigerant circuit 30.

The first and second pressure chambers 49, 50 of the control valve CV need not constitute the refrigerant circuit. In this case, the pressures PdH, PdL at two points in the refrigerant circuit are each introduced into the first or second pressure chamber 49, 50 through a dedicated passage. Also, the second valve body 69 is located outside the pressure sensing chamber 44 separately from the pressure sensing member 48 (the second member 64, 81) and selectively opens the discharge pressure zone (such as the discharge passage) or the suction pressure zone (such as the suction passage). In this state also, it is not required to operably connect the second valve body 69 to the pressure sensing member 48 and provide a dedicated pressure sensing mechanism for operating the second valve body 69.

The communication passage 43 may be connected to the discharge chamber 22 via the upstream section of the supply passage 28 and the valve chamber 42 may be connected to the crank chamber 12 via the downstream of the supply passage 28. This minimizes the pressure difference between the communication passage 43 and the second pressure chamber 50, which is adjacent to the communication passage 43. As a result, the pressure is prevented from leaking between the communication passage 43 and the second pressure chamber 50, thereby enabling highly accurate displacement control.

The control valve CV may be an outlet control valve, which controls the crank pressure by adjusting the opening degree of the bleed passage 27 instead of the supply passage 28.

The present invention may be applied to a control valve that can vary the target suction pressure or the target discharge pressure.

The inclination angle of the swash plate 15 may be varied by the operation of the fluid pressure actuator. In this case, the pressure chamber of the fluid pressure actuator serves as the control pressure chamber.

The present invention may be embodied in a wobble plate type variable displacement compressor.

A clutch mechanism, such as an electromagnetic clutch, may be applied as the power transmission mechanism PT.

Therefore, the present examples and embodiments are to be considered as illustrative and not restrictive and the invention is not to be limited to the details given herein, but may be modified within the scope and equivalence of the appended claims.

What is claimed is:

1. A controlled valve for controlling the displacement of a variable displacement compressor that is incorporated in a refrigerator circuit, wherein the compressor includes a control pressure chamber, and the displacement of the compressor varies in accordance with the pressure in the control pressure chamber, the control valve comprising:

a first valve body for varying a valve opening to adjust the pressure in the control pressure chamber;

a pressure sensing member, which is displaced in accordance with the pressure in the refrigerant circuit to move the first valve body such that the displacement of the compressor is controlled to cancel the fluctuation of the pressure in the refrigerant circuit;

an actuator for urging the pressure sensing member by a force that corresponds to an external command to determine a target value of the pressure in the refrigerant circuit; and a second valve body, which is operably coupled to the pressure sensing member, wherein the second valve body adjusts the opening degree of a refrigerant passage, which forms a part of the refrigerant circuit, in accordance with the displacement of the pressure sensing member.

2. The control valve according to claim 1, wherein the pressure sensing member moves the first valve body in accordance with the pressure difference between two pressure points located in the refrigerant circuit thereby controlling the displacement of the compressor to cancel the fluctuation of the pressure difference between the pressure points, and wherein the actuator urges the pressure sensing member by a force that corresponds to the external command to determine the target value of the pressure difference.

3. The control valve according to claim 2, wherein the second valve body is located in the refrigerant passage between the two pressure points and functions as a restrictor.

4. The control valve according to claim 2, further comprising a valve housing, which defines a pressure sensing chamber, wherein the pressure sensing member is arranged in the pressure sensing chamber to define a first pressure chamber and a second pressure chamber in the pressure sensing chamber, and wherein the first pressure chamber is exposed to the pressure at the upstream one of the pressure points and the second pressure chamber is exposed to the pressure at the downstream one of the pressure points.

5. The control valve according to claim 4, wherein at least one of the first pressure chamber and the second pressure chamber constitutes a part of the refrigerant circuit.

6. The control valve according to claim 5, wherein the second valve body is arranged in one of the pressure chambers that constitutes a part of the refrigerant circuit, and wherein the second valve body adjusts the opening degree of a valve hole, which is open to the pressure chamber.

7. The control valve according to claim 6, wherein the pressure sensing member includes a first member, which is operably coupled to the first valve body, a second member, which is operably coupled to the second valve body, and an urging member located between the first member and the second member, and wherein the urging member urges the first member toward the first valve body and urges the second member toward the valve hole.

8. The control valve according to claim 5, wherein the first pressure chamber and the second pressure chamber both constitute a part of the refrigerant circuit.

9. The control valve according to claim 8, wherein a space exists between the outer surface of the pressure sensing member and the wall of the valve housing that defines the pressure sensing chamber, wherein the space connects the first pressure chamber to the second pressure chamber and functions as a chamber-to-chamber passage, which constitute a part of the refrigerant circuit.

10. The control valve according to claim 9, wherein the pressure sensing member has an outer circumferential surface that faces the space, and wherein the outer circumferential surface is tapered such that the diameter of the outer circumferential surface decreases toward the first pressure chamber.

11. The control valve according to claim 1, wherein the refrigerant circuit includes the compressor and an external refrigerant circuit, which is connected to the compressor, wherein the compressor includes a suction chamber for receiving refrigerant from the external refrigerant circuit and a discharge chamber, which is filled with compressed refrigerant to be discharged to the external refrigerant circuit, and wherein the second valve body is located in the refrigerant passage between the discharge chamber and a condenser of the external refrigerant circuit or in the refrigerant passage between an evaporator of the external refrigerant circuit and the suction chamber.

12. The control valve according to claim 11, wherein the second valve body closes the refrigerant passage when the displacement of the compressor is minimized.

13. The control valve according to claim 12, wherein the compressor is always coupled to an external drive source.

14. The control valve according to claim 1, further comprising a valve housing, wherein the valve housing has a first housing assembly, which includes the first valve body and the actuator, and a second housing assembly, which includes the pressure sensing member and the second valve body, and wherein the first housing assembly is fitted to the second housing assembly such that the first valve body abuts against and is operably coupled to the pressure sensing member.

15. The control valve according to claim 14, the operating characteristics of the first valve body is determined in accordance with a fitting length between the first housing assembly and the second housing assembly along the moving direction of the first valve body.

16. The control valve according to claim 1, wherein the second valve body is integrally formed with the pressure sensing member.

17. A control valve for controlling the displacement of a variable displacement compressor that is incorporated in a refrigerant circuit, wherein the compressor includes a control pressure chamber, and the displacement of the compressor varies in accordance with the pressure in the control pressure chamber, the control valve comprising:

a first valve body for varying a valve opening to adjust the pressure in the control pressure chamber;

a pressure sensing member, which is displaced in accordance with the pressure difference between two pressure points located in the refrigerant circuit to move the first valve body such that the displacement of the compressor is controlled to cancel the fluctuation of the pressure difference between the pressure points;

an actuator for urging the pressure sensing member by a force that corresponds to an external command to determine a target value of the pressure difference;

a second valve body, which is operably coupled to the pressure sensing member, wherein the second valve body adjusts the opening degree of a refrigerant passage, which forms a part of the refrigerant circuit, in accordance with the displacement of the pressure sensing member; and a valve housing, wherein the first valve body, the pressure sensing member, the actuator, and the second valve body are embedded in the valve housing.

18. The control valve according to claim 17, wherein the second valve body is located in the refrigerant passage between the pressure points and functions as a restrictor.

19. The control valve according to claim 17, wherein the valve housing has a pressure sensing chamber, which is located in the refrigerant circuit, wherein the pressure sensing member is arranged in the pressure sensing chamber to define a first pressure chamber and a second pressure chamber in the pressure sensing chamber, wherein the first pressure chamber is located upstream of the refrigerant circuit than the second pressure chamber.

20. The control valve according to claim 19, wherein the second valve body is arranged in the first pressure chamber and is integrally formed with the pressure sensing member.

* * * * *

UNITED STATES PATENT AND TRADEMARK OFFICE

CERTIFICATE OF CORRECTION

PATENT NO. : 6,783,332 B2
DATED : August 31, 2004
INVENTOR(S) : Satoshi Umemura et al.

It is certified that error appears in the above-identified patent and that said Letters Patent is hereby corrected as shown below:

Column 16,
Line 14, please insert -- wherein -- after "claim 14,"

Signed and Sealed this

Twenty-first Day of December, 2004

JON W. DUDAS
*Director of the United States Patent and Trademark Office*